US007090549B2

(12) United States Patent
Garcia

(10) Patent No.: US 7,090,549 B2
(45) Date of Patent: Aug. 15, 2006

(54) SYSTEM TO PROPEL AN AIR POWERED BOAT

(76) Inventor: Phillip P. Garcia, P.O. Box 6751, Ocean View, HI (US) 96737-8637

( * ) Notice: Subject to any disclaimer, the term of this patent is extended or adjusted under 35 U.S.C. 154(b) by 0 days.

(21) Appl. No.: 10/698,583

(22) Filed: Oct. 31, 2003

(65) Prior Publication Data

US 2005/0095930 A1 May 5, 2005

(51) Int. Cl.
*B63H 7/02* (2006.01)

(52) U.S. Cl. ..... 440/37; 114/61.1

(58) Field of Classification Search ..... 440/37; 180/116–130; 114/67 A, 272, 273, 288–290, 114/61.1, 39.26, 43
See application file for complete search history.

(56) References Cited

U.S. PATENT DOCUMENTS

| | | | | |
|---|---|---|---|---|
| D161,871 | S | 2/1951 | Reuther | |
| 3,065,929 | A * | 11/1962 | Holland, Jr. | 244/12.4 |
| 3,159,361 | A * | 12/1964 | Weiland | 244/12.1 |
| 3,176,647 | A * | 4/1965 | Grengs et al. | 440/37 |
| 3,335,977 | A * | 8/1967 | Meditz | 244/12.4 |
| 3,529,566 | A | 9/1970 | Troeng | |
| 3,608,662 | A * | 9/1971 | Ferguson | 180/117 |
| 3,656,575 | A * | 4/1972 | Vryland | 180/120 |
| 3,791,333 | A * | 2/1974 | Losch | 440/72 |
| 3,827,527 | A * | 8/1974 | Bertelsen | 180/120 |
| 3,861,491 | A * | 1/1975 | Ferguson | 180/120 |
| 3,890,771 | A * | 6/1975 | Kelpin | 56/9 |
| 4,171,784 | A * | 10/1979 | Eickmann | 244/2 |
| 4,175,636 | A | 11/1979 | Broughton | |
| 4,282,946 | A * | 8/1981 | MacGuire | 180/128 |
| 4,322,208 | A | 3/1982 | Kelpin | |
| 4,421,489 | A * | 12/1983 | Van Veldhuizen | 440/37 |
| 4,593,640 | A | 6/1986 | Blunschi | |
| 4,712,630 | A | 12/1987 | Blum | |
| 4,724,785 | A | 2/1988 | Van Hauwaert | |
| 4,738,212 | A | 4/1988 | Schweitzer | |
| 4,828,058 | A * | 5/1989 | Bjorn-Ake | 180/117 |
| 4,880,071 | A * | 11/1989 | Tracy | 180/117 |
| 4,932,839 | A | 6/1990 | Pitchford | |
| 5,242,132 | A * | 9/1993 | Wukowitz | 244/106 |
| 5,622,133 | A | 4/1997 | Sinitsyn et al. | |
| 5,711,494 | A * | 1/1998 | Saiz | 244/12.1 |
| 6,413,125 | B1 | 7/2002 | Duer | |
| 6,715,574 | B1 * | 4/2004 | Bertelsen et al. | 180/122 |

FOREIGN PATENT DOCUMENTS

| | | | |
|---|---|---|---|
| FR | 0429540 A * | 11/1911 | 440/37 |
| FR | 0570307 A * | 1/1924 | 440/37 |

(Continued)

*Primary Examiner*—Ajay Vasudeva
(74) *Attorney, Agent, or Firm*—Michael R. McKenna

(57) ABSTRACT

Air propulsion system for a boat comprises an internal combustion engine for powering a propeller in a single rotational direction. A pivoting mechanism pivots the propulsion system through a 360 degree arc about a transverse horizontal axis from a first position in which the propeller produce a forward thrust, through a second position in which the propeller produces a downward neutral thrust and a turning torque, to a third position in which the propeller produce a reverse thrust, to a fourth position in which the propeller produces an upward neutral thrust and a turning torque. The turning torque produced by the propeller turns the boat to the left in the second position and to the right in the fourth position. The engine is adapted to pivot with the propeller and continues to operate under throttle control in all pivoted orientations.

6 Claims, 3 Drawing Sheets

FOREIGN PATENT DOCUMENTS

| | | | | |
|---|---|---|---|---|
| FR | 0612228 A | * | 7/1926 | ..... 440/37 |
| FR | 2397963 A | * | 3/1979 | |
| GB | 2098942 A | * | 12/1982 | |
| GB | 2120990 A | * | 12/1983 | |
| JP | 01309867 A | * | 12/1989 | |
| JP | 04215560 A | * | 8/1992 | |
| RU | 2002655 C1 | * | 11/1993 | |
| WO | WO 2003097438 A2 | * | 11/2003 | |

* cited by examiner

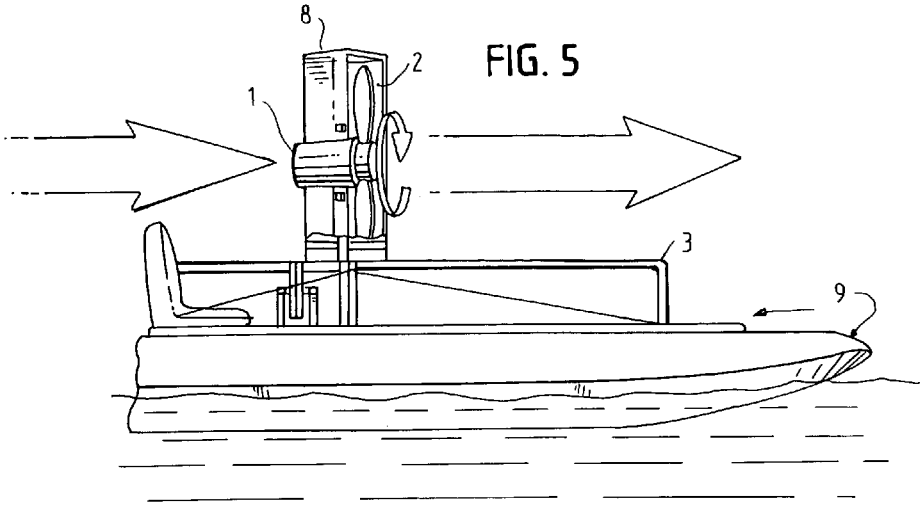
FIG. 5
FIG. 6
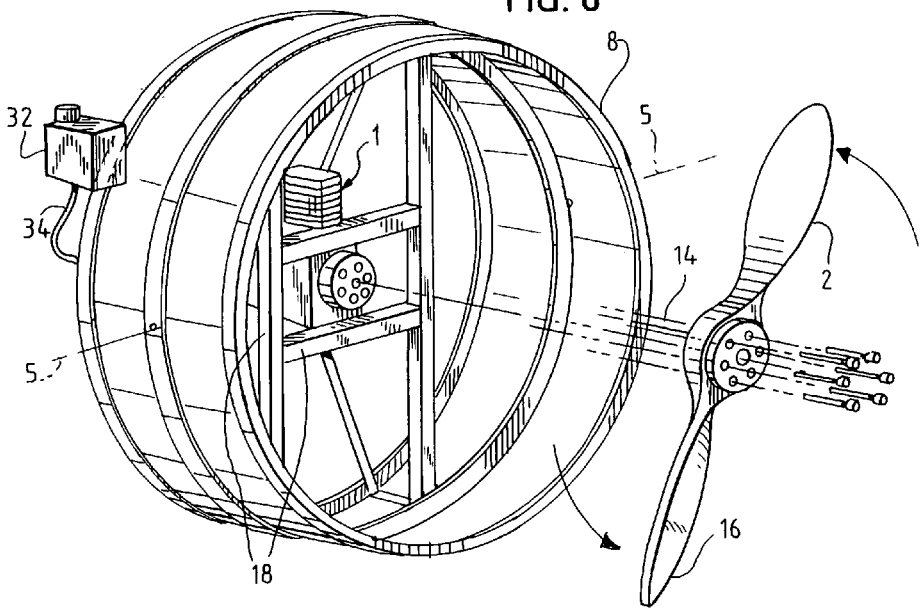

SYSTEM TO PROPEL AN AIR POWERED BOAT

BACKGROUND OF THE INVENTION

The present invention relates generally to a system for propelling an air boat, generically referring to flat bottomed boats, kayaks, and dual and multi-hulled aquatic crafts, including outriggers and catamarans. Even still more particularly, this invention relates to a system which permits the swivel mounting of an internal combustion engine powering a propeller in which the propeller can rotate roughly 180 degrees about a horizontal axis to propel the air boat in forward, reverse and neutral directions, while permitting continuous operating control of the throttle. Preferably, the system permits the swivel mounting of an internal combustion engine powering a propeller and the propeller can rotate roughly 360 degrees about the horizontal axis to propel the air boat in forward, reverse and two neutral turning directions, while permitting continuous operating control of the throttle. This will facilitate the turning motion discussed hereinafter.

This invention relates to a system to propel an air powered boat with means for rotating a propeller about a transverse horizontal axis from a first position in which the propeller produces a thrust to move the boat in a forward direction through a second position in which the propeller produces a downward neutral thrust to a third position in which the propeller produces a thrust to move the boat in reverse through a fourth position in which the propeller produces an upward neutral thrust, while the engine continues running. It comprises means for propelling the air boat in any one of a forward, reverse and neutral direction with an engine powering the propeller in a single rotational direction. When the propeller is disposed in the second position in which the propeller produces a downward thrust, the torque from the engine/propeller assembly acts to turn the boat to the left. The reverse is true when the propeller is disposed in the fourth position. Means for securing the means for propelling to the air powered boat are also provided.

Alternative technology is available in the form disclosed in earlier patents issued for air boats which include U.S. Pat. No. 4,724,785 issued in 1988 to Van Hauwaert for a frame support for connecting two float members with a fan supported on a frame. Similarly, in U.S. Pat. No. 3,176,647 issued to Grengs et al. in 1961 for a rescue craft with a similar fan supported rigidly by a frame. No means of reversing the boat without the use of a reversible engine were taught.

Prior aerodynamic styled propellers operate to power and steer an aquatic craft by pivotally mounting the propeller and engine on a vertical axis. In such case, the ability of the steering apparatus to smoothly maneuver the craft is limited. See U.S. Pat. No. 6,413,125 issued in 2002 to Duer for a canoe air propulsion machine which is pivotally mounted and rotatable about a vertical axis. A similar vertical rotation is shown in U.S. Pat. No. 4,932,839 issued in 1990 to Pitchford for a propulsion and steering apparatus.

To alleviate this problem, and others which will become apparent from the disclosure which follows, the present invention conveniently has the ability to rotate the propeller, to dispose the propeller's rotational axis to a rear horizontal position to propel the boat forward, to a forward horizontal position to propel the boat in reverse and to a vertical position, while the engine continues to run. When the propeller axis is vertically disposed, the air boat is propelled in a neutral turning direction, neither forward nor reverse.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach either stationary or mounted pivotally about a vertical axis fan propulsion systems, the present invention teaches a system to propel an air powered boat with means for rotating, or pivoting, the propeller about a transverse horizontal axis. The propeller rotates from a first position in which the propeller produces a thrust to move the boat in a forward direction through a second position in which the propeller produces a downward neutral thrust to a third position in which the propeller produces a thrust to move the boat in reverse, while the engine continues running. Preferably, a fourth position can be obtained which produces an upward neutral thrust.

Additionally, it comprises means for propelling the air boat in any one of a forward, reverse and neutral turning directions with an engine powering the propeller in a single rotational direction. Thus, a single direction non-reversing engine will suffice for the present invention to propel the boat in any one of a forward, reverse and neutral turning directions. Moreover, the system preferably permits the swivel mounting of an internal combustion engine powering a propeller and the propeller to rotate roughly 360 degrees about the horizontal axis to propel the air boat in a forward, reverse and both neutral directions, so that some steering capability is produced as well.

Another advantage of the system to propel an air powered boat disclosed herein is the cost savings experienced by using a single direction engine in lieu of a more expensive reversible engine. Since reversal of the thrust direction is accomplished by rotating the means for propelling, only an engine with one-way rotation is required. In the present invention a change of thrust direction can be accomplished without destabilizing the boat and it can be accomplished without substantially throttling down the engine during the procedure. Prior art propulsion systems that utilize a vertical axis of rotation for the propulsion system require a throttling down of the engine during rotation of the propulsion system so as not to destabilize the boat. The engine powering the propeller of the present invention is preferably a variable speed engine operable in a single rotational direction.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to a system to propel an air powered boat comprising means for propelling the air boat in any one of a forward, reverse and neutral direction having an engine powering a propeller in a single rotational direction; and means for securing the means for propelling to the air powered boat. The means for propelling includes means for rotating the propeller about a transverse horizontal axis from a first position in which the propeller produces a thrust to move the boat in a forward direction through a second position in which the propeller produces a downward neutral thrust to a third position in which the propeller produces a thrust to move the boat in reverse and a fourth position in which an upward thrust is produced. This invention has the ability to rotate the propeller, to dispose the propeller's rotational axis to a rear horizontal position to propel the boat forward, to a forward horizontal position to propel the boat in reverse and to a vertical position, while the engine continues to run.

Preferably, the direction of thrust from the propeller can be rotated through a 360 degree arc as the propeller is rotated about the horizontal axis to propel the air powered boat in one of a forward direction, an upward or downward neutral direction, and a reverse direction. When the propeller is thus vertically disposed, the air boat is propelled in one of two neutral direction, neither forward nor reverse.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein:

FIG. 5 is a fragmentary side elevation view with a portion of the shroud removed to show the motor and propellor arrangement within the shroud;

FIG. 6 is an exploded perspective view of the shroud and a bracing disposed therein which supports the propellor and motor, with the propellor exploded away from the motor, and further showing a fuel reservoir disposed at an elevation above the internal combustion engine and the transverse horizontal axis about which the means for propelling rotates;

DETAILED DESCRIPTION OF THE INVENTION

Figure 1:
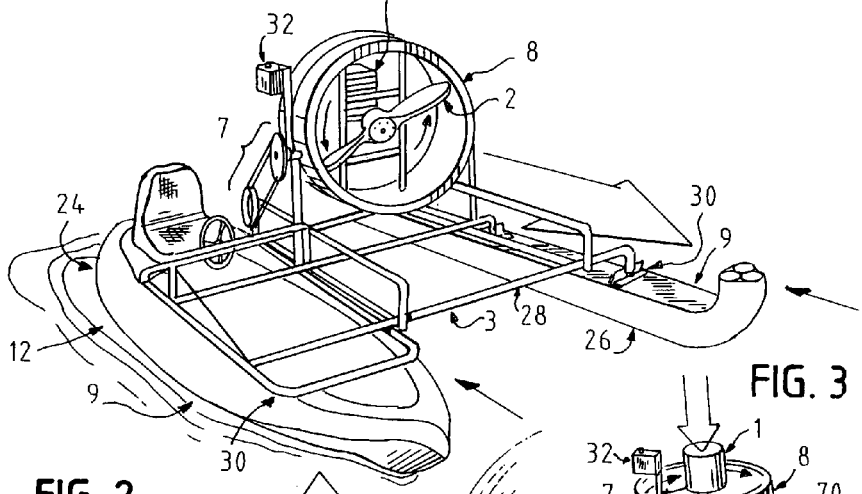
FIG. 1 is a perspective view of a system to propel an air powered boat with the means for propelling rotated about a transverse horizontal axis to a third position in which a thrust is produced with the propellor rotating counterclockwise when viewed from the propellor end disposed to propel the boat in a reverse direction.
Figure 2:
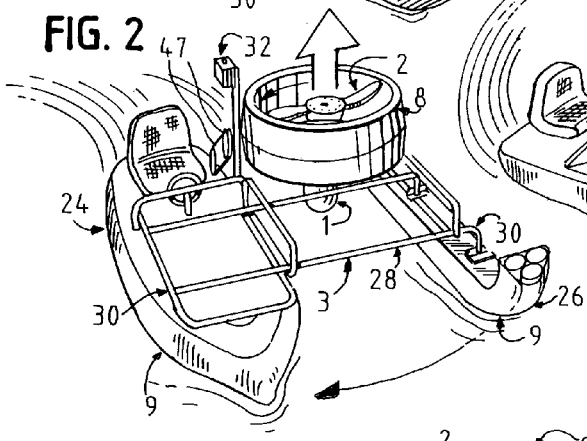
FIG. 2 is a perspective view of the system with the means for propelling rotated about the transverse horizontal axis to a fourth position in which an upward thrust is produced with the propellor rotating counterclockwise when viewed from the propellor end which results in the boat being turned to the starboard side direction resulting from the opposite rotation of the motor and fan.
Figure 3:
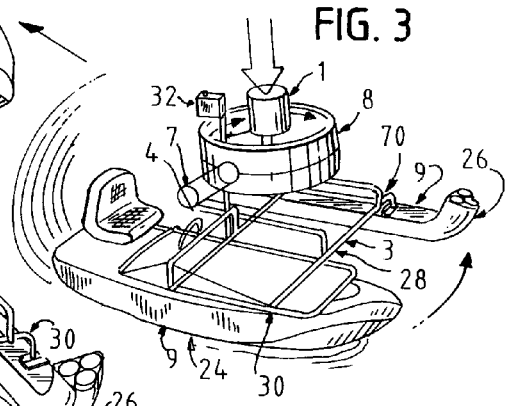
FIG. 3 is a perspective view of the system with the means for propelling rotated about the transverse horizontal axis to a second position which a downward thrust is produced with the propellor rotating counterclockwise when viewed from the propellor end which results in the boat being turned to the port side direction.
Figure 4:
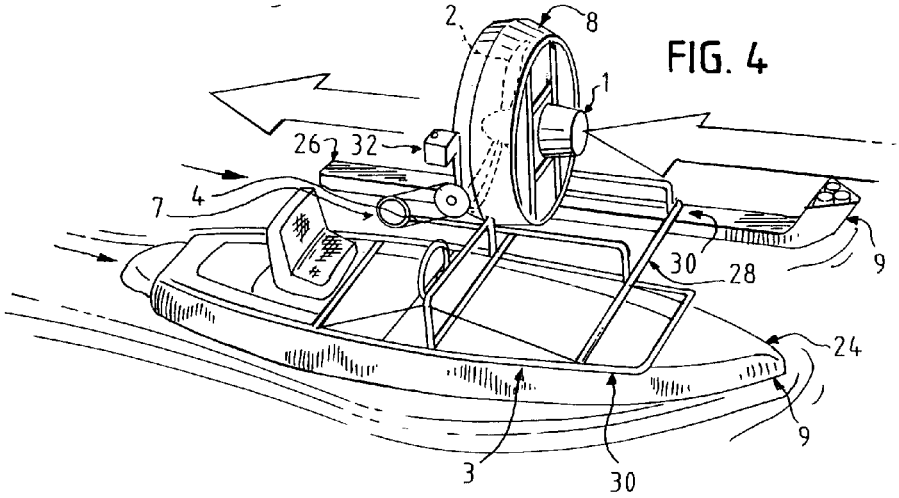
FIG. 4 is a perspective view of the system to propel an air powered boat of the current invention showing the means for propelling rotated about the transverse horizontal axis to a first position in which a thrust is produced with the propellor rotating counterclockwise when viewed from the propellor end to propel the boat in a forward direction.
Figure 7:
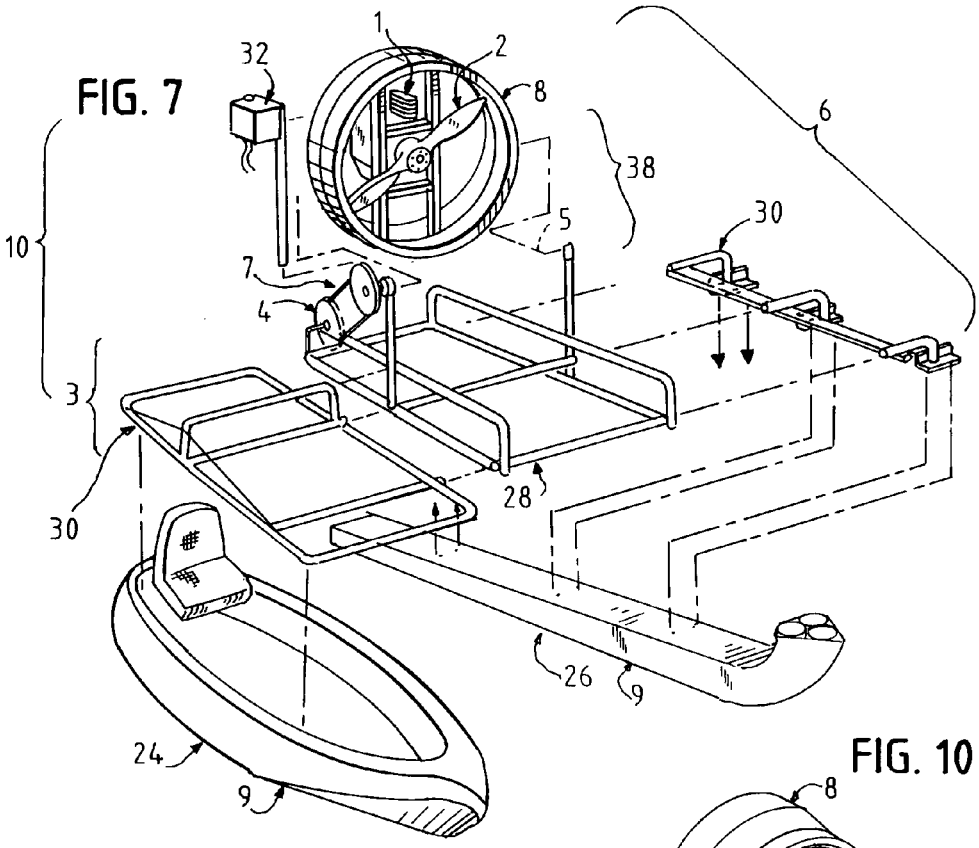
FIG. 7 is an exploded perspective view showing the means for propelling exploded away from a frame comprising a primary member and two secondary members which are exploded away from the buoyant members.

The preferred embodiments depicted in the drawing comprise a system to propel an air powered boat comprising means for propelling 10 the air boat 12 in any one of a forward, reverse and neutral turning direction having an engine 1 powering a propeller 2 in a single rotational direction (shown by rotational arrows), and a frame 3 for securing the means for propelling to the air powered boat. The single rotational direction is shown to be clockwise when viewing the rotating shaft of the engine/propeller from the engine end. One skilled in the art could easily adapt a counterclockwise rotating power source and reverse the directions of movement to the air boat contemplated herein. The means for propelling includes means for rotating 4 the propeller 2 about a transverse horizontal axis 5 from a first position in which the propeller produces a thrust to move the boat forward (as shown in FIG. 4) through a second position in which the propeller produces a downward neutral thrust turning torque (as shown in FIG. 3) to a third position in which the propeller produces a thrust to move the boat in reverse (as shown in FIG. 1) and to a fourth position in which the propeller produces an upward neutral thrust turning torque (as shown in FIG. 2). This invention has the ability to rotate the propeller, to dispose the propeller's rotational axis to a rear horizontal position to propel the boat forward, to a forward horizontal position to propel the boat in reverse and to two vertical positions, while the engine 1 continues to run. The engine powering the propeller being a variable speed engine operable in a single rotational direction, as set forth in claim 7.

Without departing from the generality of the invention disclosed herein and without limiting the scope of the invention, the discussion that follows, will refer to the invention as depicted in the drawing.

The preferred embodiments of the apparatus depicted in the drawing comprise a system to propel an air powered boat is taught by the present invention which comprises means for propelling 10 the air boat in any one of a forward, reverse and neutral turning directions having an engine 1 powering a propeller 2 in a single rotational direction; and means for securing 6 the means for propelling 10 to the air powered boat 12.

One of the unique features of this invention is the ability to rotate the propeller's rotational axis 14 to at least one vertical position while the engine continues to run. When the propeller is thus vertically disposed, the air boat is propelled in a neutral thrust turning direction, neither forward nor reverse. This neutral thrust turning direction tends to turn the air boat to the starboard side or to the port side without substantially moving it forward or reverse. The means for propelling 10 includes means for rotating 4 the propeller 2 about a transverse horizontal axis 5 from a first position in which the propeller produces a thrust to move the boat forward through a second position in which the propeller produces a downward neutral thrust turning torque to a third position in which the propeller produces a thrust to move the boat in reverse and, in a preferred embodiment, to a fourth position in which an upward thrust is produced. Preferably, the direction of thrust (shown by the linear arrow outlines in FIGS. 1–5) from the propeller can be rotated through a 180 or 360 degree arc as the propeller is rotated about the horizontal axis to propel the air powered boat in one of a forward direction, a neutral turning direction, and a reverse direction. As best shown in FIG. 6, the transverse horizontal axis 5 may lie in a plane that is perpendicular to the longitudinal axis of the air powered boat 12. In instances where the propeller is rotated 360 degree about the horizontal axis to propel the air powered boat, control can be accomplished by interposing a universal coupling in the throttle cable. This coupling permits axial translation of the throttle cable along its entire length to control the throttle setting as well as unlimited rotational movement of the end of the cable attached to the engine. This can be accomplished by mounting one end of the throttle control cable to the coupling body and the other end to a shaft having a head secured in the coupling body for swiveling movement within the coupling body.

The means for rotating 4 the propeller 2 includes a direct drive 7 controllable by a pilot to rotate the propeller about the transverse horizontal axis 5 to one of the first position, second position, third position and preferably a fourth position. Moreover, the propeller is preferably of an aerodynamic design 16 for producing thrust, as shown in FIG. 6.

As best shown in FIG. 6, the means for propelling 10 has a tangential shroud 8 which supports the propeller 2 and rotates about the transverse horizontal axis 5 with the propeller. Thus, although not specifically shown in the drawing, the rotating propeller 2 could be independently supported by the shroud 8 and the engine could be independently supported by a frame 3. As shown in the drawing, however, both the propeller 2 and the engine 1 powering it are supported by the shroud 8. The shroud 8 has an internal framework 18 for supporting the propeller 2, as shown in FIG. 6.

In the system to propel an air powered boat, the means for securing 6 the means for propelling 10 to the air powered boat 12 may comprise a frame 3 adapted for use in supporting the engine 1 powering a propeller 2 in an operative position on the air powered boat. Moreover, the frame 3 may be mounted on the air powered boat, as shown in FIGS. 1–4. It will be clear to one skilled in the art, that the system to propel an air powered boat of this important invention can be adapted for use on a variety of boats and buoyant members. The frame 3 which supports the means for propelling 10 can include an assortment of lateral sections 20 which can be fastened by traditional means to a primary frame 22 and to any number and shape of boat or buoyant member 9, including but not limited to one of a boat hull, a pontoon, a float, and a timber. The final adaptation may form an outrigger, or a dual or tri-hulled vehicle.

In an environment which includes an air powered boat 12 having a plurality of buoyant members 9, the system to propel the air powered boat may comprise means for propelling 10 the air boat in any one of a forward, reverse and neutral turning direction having an engine 1 powering a propeller 2 in a single rotational direction, and means for securing 6 the means for propelling 10 to the air powered boat 12 having a frame 3 adapted for use in supporting the engine 1 powering a propeller 2 in an operative position on the air powered boat. The frame 3 can be mounted on the air powered boat, as shown in FIGS. 1–5 and 8–9, and secure each of the plurality of buoyant members 9 to one another.

Additionally, the plurality of buoyant members 9 may include at least one primary hull 24 in which a pilot may operate the air powered boat and at least one secondary hull 26, and the frame 3 may comprise a primary member 28 for supporting the means for propelling 10 and at least one secondary member 30. Each of the at least one secondary member 30 extends laterally from the primary member 28. The primary member can be fastenable to the at least one primary hull 24, and each at least one secondary member 30 can be fastenable to one of the at least one secondary hull 26. In this way, the engine 1 powering the propeller 2 can be supported by each of the plurality of buoyant members 9.

Specifically, the plurality of buoyant members 9 may preferably include a primary hull 24 in which a pilot may operate the air powered boat and a secondary hull 26, and the frame 3 may comprise a primary member 28 for supporting the means for propelling 10 and a secondary member 30 that extends laterally from the primary member 28. The primary member 28 can be fastenable to the primary hull 24 and the secondary member 30 can be fastenable to the secondary hull 26. Whereby, the engine powering a propeller can be supported by each of the plurality of buoyant members.

Figure 8:
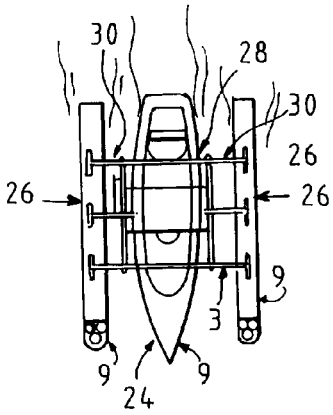
FIG. 8 is a schematic plan view of the system for propelling an air boat with the primary member of the frame supporting the means for propelling disposed on a primary hull and lateral secondary members of the frame connecting auxiliary buoyant members to the primary member of the frame and the primary hull.
Figure 9:
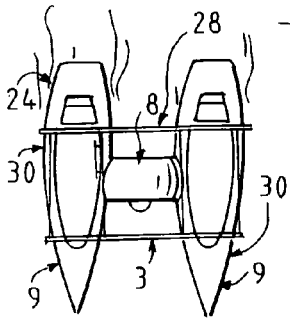
FIG. 9 is a schematic plan view of the system for propelling an air boat with the primary member of the frame supporting the means for propelling disposed between two secondary members of the frame that connect two buoyant members to the primary member of the frame.

Alternatively, the plurality of buoyant members 9 can include a primary hull 24 in which a pilot may operate the air powered boat and two secondary hulls 26, and the frame 3 can comprise a primary member 28 for supporting the means for propelling 10 and two secondary members 30, with each of the two secondary members extendible laterally from opposing sides of the primary member. The primary member 28 can be fastenable to the primary hull 24 and each of the two secondary members 30 can be fastenable to one of the two secondary hulls 26, as shown in FIG. 8. In this configuration, the engine powering a propeller is supported by each of the plurality of buoyant members.

A preferred embodiment of the system to propel an air powered boat comprises an internal combustion engine. Furthermore, a fuel system with a fuel reservoir 32 supported on the frame 3 may be provided being disposed at an elevation above the internal combustion engine so that the fuel can be feed to the engine by gravity, as best shown in FIG. 6. Preferably, the fuel system with a fuel reservoir supported on the frame 3 may be provided with the fuel reservoir 32 disposed at an elevation above the transverse horizontal axis so that the fuel can be feed to the engine by gravity. Referring to FIG. 6, the fuel system further may comprise a flexible fuel line 34 between the fuel reservoir 32 and the engine 1.

Another preferred aspect of the system to propel an air powered boat comprises the means for propelling including means for rotating 4 the engine 1 with the propeller 2 about the transverse horizontal axis 5 and the flexible fuel line 34 adapted for use as the engine 1 is rotated about the transverse horizontal axis 5.

Figure 10:
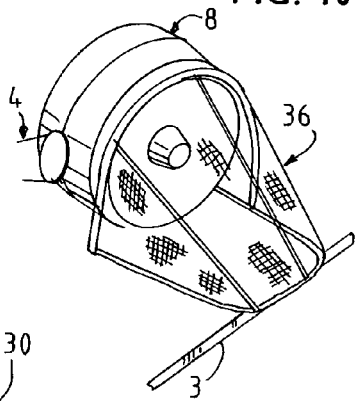
FIG. 10 is a fragmentary perspective view showing the means for propelling being shielded from debris by a stationary screen disposed forward the means for propelling as the air powered boat is moving in a forward direction.

Additionally, referring to FIG. 10, the means for securing 6 of the system to propel an air powered boat may comprise a stationary screen 36 disposed forward the means for propelling 10 for blocking debris from entering the means for propelling when the air powered boat is moving in a forward direction.

Furthermore, preferably the system to propel an air powered boat includes means for propelling 10 that is continuously operable in a swivel mounting 38 as the propeller is rotatable 180 degrees about the transverse horizontal axis 5 to change directions from one of the forward, reverse and neutral turning directions to any other of the forward, reverse and neutral turning directions.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scop of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air powered boat having an air propulsion system comprising:

a) means for propelling the boat in every one of a forward, reverse and at least one neutral thrust turning direction having an engine powering a propeller in a single rotational direction, said engine is an internal combustion engine, said means for propelling includes a pivoting mechanism for pivoting the propeller about a transverse horizontal axis from a first position in which the propeller produces a thrust to move the boat forward through a second position in which the propeller produces a downward neutral thrust to a third position in which the propeller produces a thrust to move the boat in reverse;

b) a securing mechanism attaching the means for propelling to the boat; and c) a fuel system with a fuel reservoir supported on a frame at an elevation above the internal combustion engine so that the fuel is fed to the engine by gravity when the propeller is in any pivoted orientation.

2. An air powered boat having an air propulsion system comprising:

a) means for propelling the boat in every one of a forward, reverse and at least one neutral thrust turning direction having an engine powering a propeller in a single rotational direction, said engine is an internal combustion engine, said means for propelling includes a pivoting mechanism for pivoting the propeller about a transverse horizontal axis from a first position in which the propeller produces a thrust to move the boat forward through a second position in which the propeller produces a downward neutral thrust to a third position in which the propeller produces a thrust to move the boat in reverse;

b) a securing mechanism attaching the means for propelling to the boat; and c) a fuel system with a fuel reservoir supported on a frame at an elevation above the transverse horizontal axis so that the fuel is fed to the engine by gravity when the propeller is in any pivoted orientation.

3. The air powered boat of claim 2, wherein the fuel system further comprises a flexible fuel line between the fuel reservoir and the engine.

4. The air powered boat of claim 3, wherein the engine is pivotable with the propeller about the transverse horizontal axis, and wherein the flexible fuel line is operational when the engine is pivoted in any orientation about the transverse horizontal axis.

5. An air powered boat having an air propulsion system comprising:

a) means for propelling the boat in every one of a forward, reverse and at least one neutral thrust turning direction having an engine powering a propeller in a single rotational direction wherein the means for propelling includes a pivoting mechanism for pivoting the propeller about a transverse horizontal axis from a first position in which the axis of the propeller is disposed horizontally to produce a thrust to move the boat forward through a second position in which the propeller produces a neutral thrust turning torque to a third position in which the axis of the propeller is disposed horizontally to produce a thrust to move the boat in reverse to a fourth position in which the propeller produces a neutral thrust turning torque, wherein the second position produces a downward neutral thrust turning torque which turns the boat to the left and the fourth position produces an upward neutral thrust turning torque which turns the boat to the right; and b) a securing mechanism attaching the means for propelling to the boat.

6. An air powered boat having an air propulsion system comprising:

a) means for propelling the air boat in every one of a forward, reverse and at least one neutral thrust turning direction having an engine powering a propeller in a single rotational direction, wherein the means for propelling includes a pivoting mechanism for pivoting the propeller about a transverse horizontal axis from a first position in which the axis of the propeller is disposed horizontally to produce a thrust to move the boat forward through a second position in which the propeller produces a neutral thrust turning torque to a third position in which the axis of the propeller is disposed horizontally to produce a thrust to move the boat in reverse; and b) a securing mechanism attaching the means for propelling to the boat, wherein the direction of thrust from the propeller is rotated through a 360 degree arc as the propeller is pivoted about the horizontal axis to propel the boat in every one of a forward direction, a neutral left thrust turning direction, a reverse direction, and a neutral right thrust turning direction.

* * * * *